US005829540A

United States Patent [19]

Peay et al.

[11] Patent Number: 5,829,540

[45] Date of Patent: Nov. 3, 1998

[54] MINE ROOF DRILL BIT AND CUTTING INSERT THEREFOR

[75] Inventors: Kent Peay, Bristol, Tenn.; David Alexander McCloskey, New South Wales, Australia; Jan Magnus Andersson, Bristol, Va.

[73] Assignee: Sandvik Rock Tools, Inc., Bristol, Va.

[21] Appl. No.: 98,062

[22] Filed: Jul. 28, 1993

[51] Int. Cl.[6] ..... E21B 10/58

[52] U.S. Cl. ..... 175/420.1; 175/427

[58] Field of Search ..... 175/420.1, 426, 175/414, 415, 417, 418; 408/223, 227

[56] References Cited

U.S. PATENT DOCUMENTS

| | | | |
|---|---|---|---|
| 2,587,980 | 3/1952 | Doepker . | |
| 2,621,548 | 12/1952 | Williams . | |
| 2,735,656 | 2/1956 | Höglund et al. . | |
| 2,751,195 | 6/1956 | Edström et al. . | |
| 2,902,260 | 9/1959 | Tilden | 175/420.1 |
| 3,163,246 | 12/1964 | Vagins et al. . | |
| 3,191,700 | 6/1965 | McKenna . | |
| 4,342,368 | 8/1982 | Denman | 175/420.1 |
| 4,492,278 | 1/1985 | Leighton . | |
| 4,568,227 | 2/1986 | Hogg | 408/224 |
| 4,637,658 | 1/1987 | Annipajo et al. | 299/79 |
| 4,984,944 | 1/1991 | Pennington, Jr. et al. | 175/420.1 X |
| 5,172,775 | 12/1992 | Sheirer et al. | 175/426 |
| 5,184,689 | 2/1993 | Sheirer et al. | 175/420.1 |
| 5,220,967 | 6/1993 | Monyak | 175/420.1 |
| 5,269,387 | 12/1993 | Nance | 175/420.1 |

*Primary Examiner*—Hoang C. Dang
*Attorney, Agent, or Firm*—Burns, Doane, Swecker & Mathis, L.L.P.

[57] ABSTRACT

A rotary roof mine bit for drilling holes in the roof of a mine, comprises a bit body and an insert mounted in the bit body. The insert is formed of a hard material such as carbide or diamond. A top surface of the insert comprises two top sections which intersect a respective main surface of the insert to define first and second non-linear cutting edge. In one embodiment each cutting edge comprises a plurality of mutually angled segments. In another embodiment each cutting edge is continuously curved. Preferably an axial notch is disposed at a center of the top surface.

6 Claims, 3 Drawing Sheets

FIG. 10
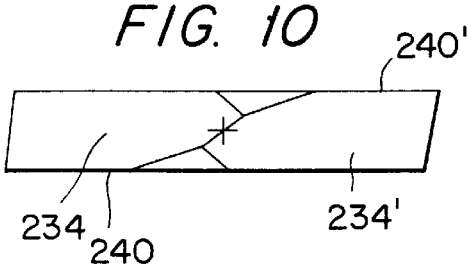
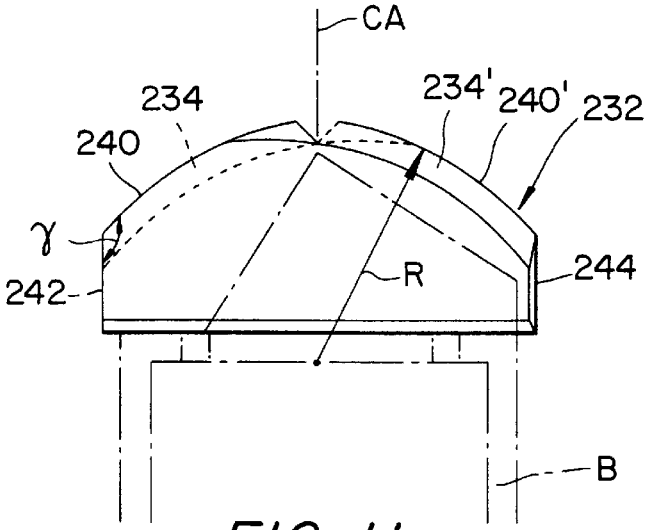
FIG. 11
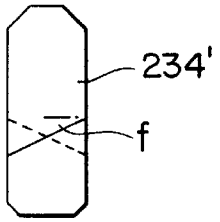
FIG. 12
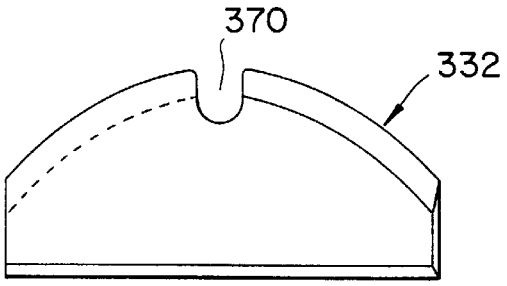
FIG. 13
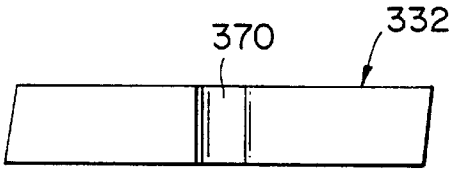
FIG. 14
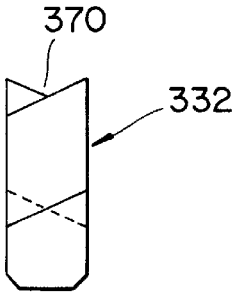
FIG. 15

MINE ROOF DRILL BIT AND CUTTING INSERT THEREFOR

BACKGROUND OF THE INVENTION

The present invention relates to the supporting of mine roofs and, in particular, to a cutting insert for use in a drill bit for cutting holes in a mine roof.

During mining operations, the roof of the mine must be supported. This has traditionally been accomplished by bolting support plates to the roof, the bolts being installed in pre-drilled holes in the mine roof.

It has been conventional to drill the bolt-receiving holes by means of a roof bit on which is mounted a cutting insert. The cutting insert, formed of a hard material such as cemented carbide for example, is mounted, e.g., by brazing, in a slot formed in a bit body, as depicted for example in U.S. Pat. No. 4,492,278. A conventional roof bit insert 10, depicted herein in FIGS. 1–4, includes a pair of linear cutting edges 12, 14 situated on opposite sides of a top face 15 of the insert. Those cutting edges are joined at the center of the insert by a linear central portion or chisel edge 16 which divides the top face into first and second sections 18,20. Each section of the top face, and thus each of the cutting edges 12, 14, extends laterally outwardly and longitudinally rearwardly with reference to the central axis of rotation A of the bit body B. Each linear cutting edge 12, 14 forms an angle e of about 105–115 degrees relative to an associated end surface 21 of the insert.

The bit body B is insertable into a hollow drill bar (not shown) which is connected to a conventional drive mechanism (not shown) that rotates the drill bar. Flushing fluid, such as air or water, is conducted through the drill bar. That fluid reaches the front face of the bit body to cool and flush the cutting edges of the insert 10.

When the bit body B is rotated, the cutting edges 12, 14 perform a boring action. The main faces 22, 24 of the insert serve as chip faces for the cutting edges 12, 14, respectively, and the top sections 18, 20 serve as chip faces for the chisel edge 16.

It has been conventional to provide a roof bit insert 10' with a center notch N, as shown in FIG. 2A. By replacing the chisel edge 16 with such a notch, the penetration rate of the conventional roof bit is increased. In that regard, a chisel edge does not perform a cutting action as such, but rather serves to grind or pulverize the center region of the hole being drilled. That, however, is not an efficient or rapid way to remove rock material. By providing a center notch in lieu of a chisel, a center core of rock material will be formed which can be more easily broken into fragments, thereby improving the penetration rate.

Although the above-described cutting inserts have generally performed acceptably in the drilling of holes in mine roofs, it would be desirable to increase the penetration rate of the bit as well as the useful life of the cutting edges of the bit.

SUMMARY OF THE INVENTION

The present invention relates to a cutting insert for rotary roof bits that are used for drilling holes in a mine roof. The insert comprises a body formed of hard material, such as carbide or diamond. The body includes first and second main surfaces, first and second end surfaces, a bottom surface, and a top surface. The first and second main surfaces are spaced apart by a thickness of the body. The first and second end surfaces are spaced apart by a width of the body. The top and bottom surfaces are spaced apart by a height of the body. A maximum width of the body is greater than a maximum height of the body. The top surface includes first and second top sections. The top section intersects the first main surface to define therewith a first cutting edge. The first top section is inclined downwardly from the first cutting edge to the second main surface to form a relief. The second top section intersects the second main surface to define therewith a second cutting edge. The second top section is inclined downwardly from the second cutting edge to the first main surface to form a relief.

In a first embodiment of the invention, each of the first and second cutting edge portions comprises at least two cutting edge segments forming an obtuse angle between one another. An outermost cutting edge segment of each cutting edge forms an angle of at least 120 degrees with the respective end surface, preferably about 135 degrees.

In a second embodiment of the invention, each of the cutting edges is continuously smoothly curved downwardly to the respective end surface. Each of the cutting edges forms an angle of at least 120 degrees with its respective end surface, preferably about 135 degrees.

In each embodiment, there is preferably provided an axial notch at the center of the top surface.

BRIEF DESCRIPTION OF THE DRAWINGS

The objects and advantages of the invention will become apparent from the following detailed description of preferred embodiments thereof in the connection with the accompanying drawings in which like numerals designate like elements, and in which:

FIG. 10 is a front end view of an insert according to another preferred embodiment of the present invention for use in a mine roof bit;

FIG. 11 is a side elevational view of the insert depicted in FIG. 7, mounted to a bit body shown in phantom lines; and FIG. 12 is view of the insert of FIG. 10 taken in a direction offset by 90° from the position shown in FIG. 11.

FIG. 13 is a view similar to FIG. 10 of a notched insert;

FIG. 14 is a view similar to FIG. 11 of the notched insert of FIG. 13; and FIG. 15 is a view similar to FIG. 12 of the notched insert of FIG. 13.

DETAILED DESCRIPTION OF PREFERRED EMBODIMENTS OF THE INVENTION

Figure 4:
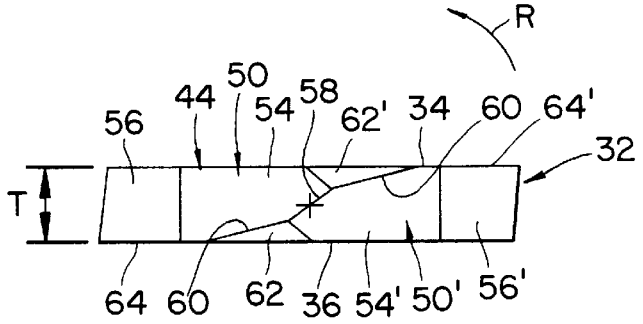
FIG. 4 is a front end view of an insert according to a first embodiment of the present invention.
Figure 6:
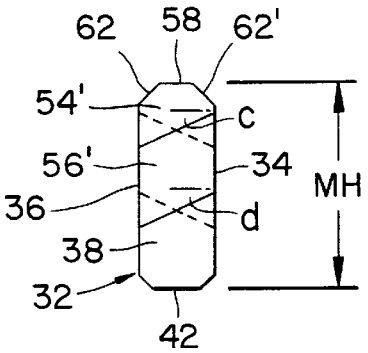
FIG. 6 is a side elevational view of the insert taken in a direction offset by 90° from the position shown in FIG. 5.
Figure 5:
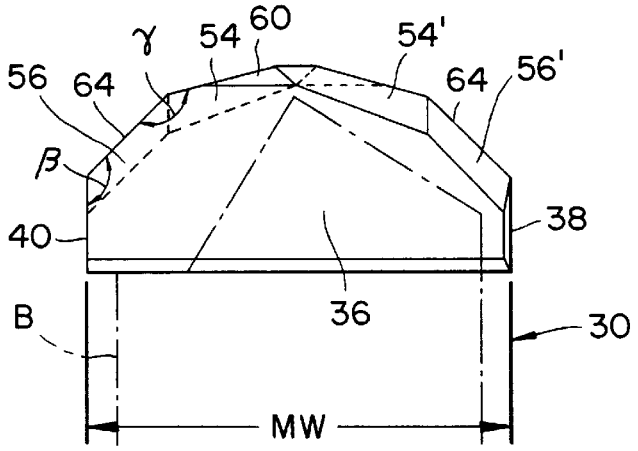
FIG. 5 is a side elevational view of the insert depicted in FIG. 4, mounted to a bit body shown in phantom lines.

A rotary roof bit 30 depicted in FIGS. 4–6 comprises an insert 32 mounted in a bit body B for rotation in direction R. The insert can be held in a recess in the bit body by any suitable means, such as brazing, friction fit, etc. Flushing fluid such as water or air is conducted through openings in the bit body cools and flushes the insert 32 in the usual manner.

The insert 32 comprises a body formed of hard material such as carbide or diamond. The insert body includes parallel first and second main or side surfaces 34, 36, first and second end surfaces 38, 40, a bottom surface 42, and a top surface 44. The main surfaces 34, 36 are spaced apart by a thickness T of the body. The end surface 38, 40 are spaced apart by a maximum width MW of the body. The top and bottom surfaces 42, 44 are spaced apart by a maximum height MH of the body. The maximum width MW of the body is greater than the maximum height MH.

The top surface 44 includes first and second top sections 50,50'. The first top section 50 comprises two mutually angled segments 54, 56. The second top section 50' also comprises mutually angled surface segments 54', 56'. The surface segments 54, 54', hereinafter referred to as "innermost surface segments" intersect one another at the center of the top surface 44 to form a chisel edge 58. The surface segments 54, 54' intersect respective one of the main surfaces 36, 34 to form therewith innermost cutting edge segments 60, 60' oriented preferably at a zero degree rake. Preferably, the main surfaces 36, 34 are beveled at 62, 62', and those beveled portions are intersected by the surface segments 54, 54'.

The surface segments 56, 56', hereinafter referred to as "outermost surface segments" also intersect respective ones of the main surfaces 36, 34 to form outermost cutting edge segments 64, 64' oriented at a zero degree rake.

The surface segments 54, 56 form an obtuse angle γ between one another, preferably about 155° degrees. The same is true of the surface segments 54', 56'.

The outermost surface segments 56, 56' form obtuse angles with their respective end surfaces 40, 38. That angle is greater than 120 degrees, preferably, about 135°.

Thus, it will be appreciated that each of the cutting edges extending from the chisel to a respective outside corner of the insert comprises a pair of cutting edge segments which are mutually angled (by angle γ) as viewed in a direction perpendicular to the main faces (i.e., as viewed in FIG. 5).

The inner surface segments 54 and 54' are inclined downwardly from their respective main surfaces at a suitable relief angle c of 20°–30°, preferably 25°, which relief angle can be viewed in FIG. 6. The outermost surface segments 56, 56' are inclined from their respective main surfaces at a relief angle d which is equal to or smaller than the relief angle c, i.e., angle d is 20°–30°, preferably 20°.

It has been found that during a cutting operation, the innermost cutting edge segments 60, 60' bore a radially inner portion of the hole in the usual manner, and that the outermost cutting edge segments 64, 64' behave more like a reaming tool which enlarges the bored hole bored by the innermost segments 60, 60'. This has resulted in an appreciable increase in the penetration rate of the bit. Furthermore, the relatively large corner angle β formed between the outermost cutting edge segments 64, 64' and their respective end surfaces 40, 38 has resulted in a slower rate of wear at those corners due to the increase in material at those corners. Those corners on a rotary drilling insert are important, because they define the outer diameter of the hole being drilled. Once those corners wear excessively, the hole cannot be drilled to the proper diameter. By reducing that rate of wear, the life of the insert is increased.

In addition, by forming each cutting edge as a plurality of mutually angled segments, i.e., as segments separated by angles γ (see FIG. 5), the overall length of each cutting edge is increased, thereby distributing the cutting forces over a greater length to reduce the rate of wear of the cutting edges themselves.

Although the main surfaces 34, 36 have been disclosed as being beveled at 62, 62', such beveling is only preferred and is not critical to the present invention.

Figure 7:
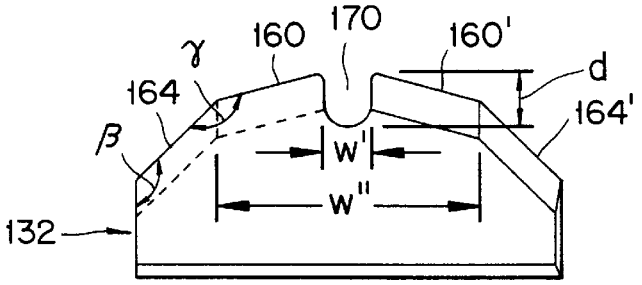
FIG. 7 is a view similar to FIG. 4 of a notched insert according to the invention.
Figure 9:
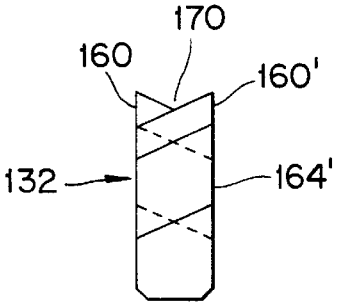
FIG. 9 is a view similar to FIG. 6 of the notched insert of FIG. 7.
Figure 8:
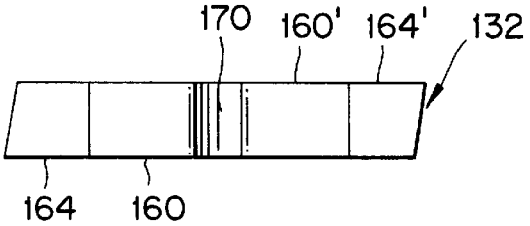
FIG. 8 is a view similar to FIG. 5 of a notched insert of FIG. 7.

Another preferred roof bit insert 132 of the present invention is depicted in FIGS. 7–9. That roof bit insert 132 is similar to the one disclosed in connection with FIGS. 4–6 except that the bevels 62, 62' have been removed, and a center notch 170 is formed in the top surface of the insert. Thus, the insert 132 includes two cutting edges, each defined by mutually angled segments 160, 164 (and 160', 164').

Figure 1:
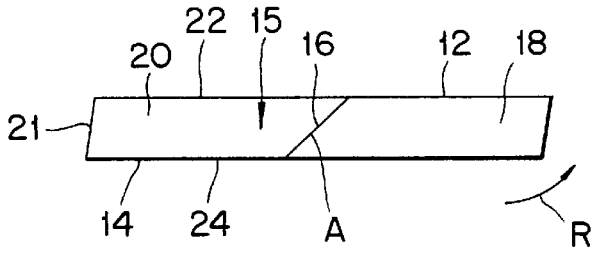
FIG. 1 (PRIOR ART)
FIG. 1 is a front end view of a prior art insert for use in a mine roof bit.
Figure 2:
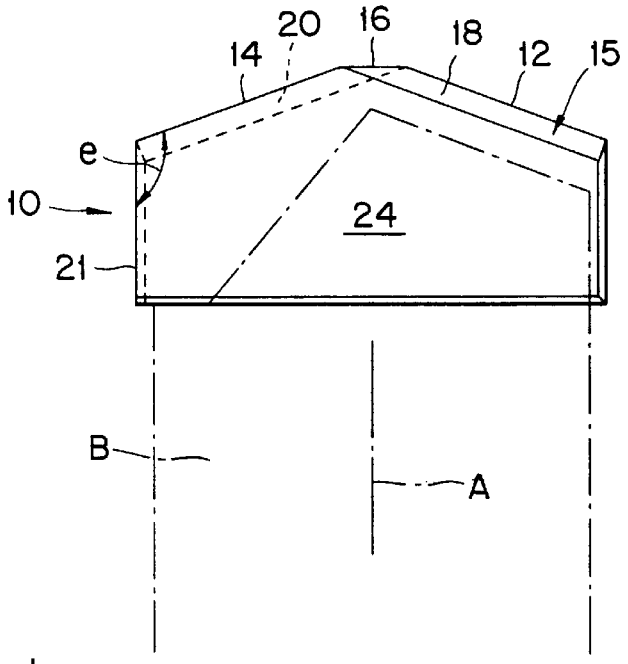
FIG. 2 (PRIOR ART)
FIG. 2 is a side elevational view of the prior art insert depicted in FIG. 1, mounted to a bit body shown in phantom lines.
Figure 2A:
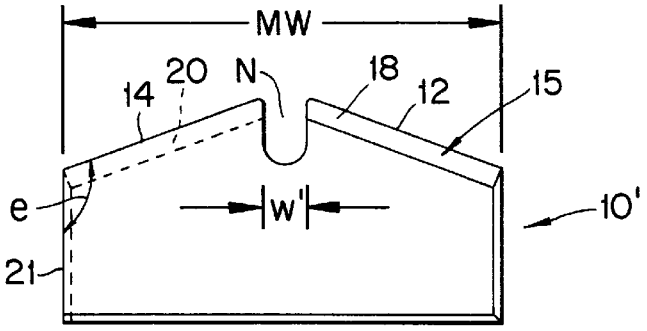
FIG. 2A (PRIOR ART)
FIG. 2A is a view similar to FIG. 2 of a notched type of conventional insert.
Figure 3:
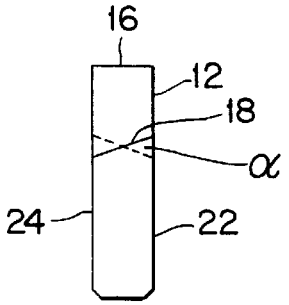
FIG. 3 (PRIOR ART)
FIG. 3 is a view of the prior art insert of FIG. 2 taken in a direction offset by 90° from the position shown in FIG. 2.

As noted earlier herein, it has been conventional to provide a center notch in a root bit insert of the type wherein each cutting edge of the insert is straight as viewed from the direction of rotation, as shown in FIG. 2A. That notch has enabled the penetration rate to be increased. It has been found, however, that the provision of a center notch 170 in an insert of the type having two multi-angled cutting edges, as shown in FIGS. 7–9, results in an insert 132 which achieves a surprisingly higher penetration rate than the FIG. 2A insert. It is surmised that this may be partially due to the earlier described boring/reaming action of the cutting edge segments 60, 64, and partially to the fact that the ratio of the notch width w' to the width w" of the boring portion of each cutting edge in the insert 132 is greater than the corresponding ratio w'/MW in the FIG. 2A insert 10', since the boring portion of the insert 132 is shorter than that of insert 10'.

It will be appreciated that the width and depth of the notch may vary, for example, in accordance with the type of earth or rock in which the drilling is performed. A smaller notch may have a width w' of about 2.8 mm and a depth d of about 3.0 mm; a larger notch may have a width w' of about 6 mm and a depth d of about 7.4 mm. In each case, the insert could have a maximum width MW of from about 25 to 40 mm, a maximum height MH of about 13.9 to 15.2 mm, and a thickness T of about 4 mm.

Depicted in FIGS. 10–12 is another embodiment of the present invention which is similar to that of the FIGS. 4–6 insert, except that the insert 232 has smoothly curved top sections 234, 234' and smoothly curved cutting edge segments 240, 240' which are continuously curved from the chisel edge to the respective outside corners. Thus, the angle which each cutting edge segment makes with a center axis CA of the insert continuously changes. The angle γ which each cutting edge 240, 240' makes with the end surfaces 242, 244 is still larger than that existing in the prior art insert of FIG. 2, i.e., angle γ is greater than 120, preferably about 135°.

The relief angle f could be constant, or it could continuously vary by becoming progressively smaller toward the outside corner.

Accordingly, the advantages relating to increased penetration rate and wear life of the cutting edges achieved in connection with the insert 32 of FIGS. 4–6 should also be achieved by the insert 232 of FIGS. 10–12.

Furthermore, the insert according to FIGS. 10–12 could also be provided with a center notch 370 as depicted in FIGS. 13–15 in order to provide an insert 332 having an even higher penetration rate for reasons discussed earlier.

It will be appreciated that the present invention provides a novel roof bit which exhibits an improved penetration rate and an enhanced wear life. It should be understood that while the insert 132 has been disclosed such that each cutting edge has two mutually angled segments 60, 64, more than two mutually angled segments could be provided, if desired.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cutting insert for a rotary roof bit used for drilling holes in a mine roof, comprising a body formed of hard material and including first and second main surfaces, first and second end surfaces, a bottom surface, and a top surface; said first and second main surfaces being spaced apart by a thickness of said body; said first and second end surfaces being spaced apart by a width of said body; said top and bottom surfaces being spaced apart by a height of said body; a maximum width of said body being greater than a maximum height of said body; said top surface including first and second top sections, said first top section intersecting said first main surface to define therewith a first cutting edge; said first top section being inclined downwardly from said first cutting edge to said second main surface to form a relief; said second top section intersecting said second main surface to define therewith a second cutting edge; said second top section being inclined downwardly from said second cutting edge to said first main surface to form a relief; each of said first and second cutting edges being continuously smoothly curved downwardly to a respective end surface and forming an angle of at least 120 degrees with said respective end surface, said body including a notch disposed at a center of said top surface, said notch extending completely across the thickness of said body.

2. A cutting insert according to claim 1, wherein said angle is about 135 degrees.

3. A cutting insert according to claim 1, wherein said relief formed by each of said first and second top sections progressively decreases from a center of said top surface toward respective ones of said end surfaces.

4. A rotary roof bit for drilling holes in a mine roof, comprising a bit body and an insert mounted in said bit body, said insert including an insert body formed of hard material and having first and second main surfaces, first and second end surfaces, a bottom surface, and a top surface; said first and second main surfaces being spaced apart by a thickness of said insert body; said first and second end surfaces being spaced apart by a width of said insert body; said top and bottom surfaces being spaced apart by a height of said insert body; a maximum width of said insert body being greater than a maximum height of said insert body; said top surface including first and second top sections, said first top section intersecting said first main surface to define therewith a first cutting edge; said first top section being inclined downwardly from said first cutting edge to said second main surface to form a relief; said second top section intersecting second main surface to define therewith a second cutting edge; said second top section being inclined downwardly from said second cutting edge to said first main surface to form a relief; each of said first and second cutting edges being continuously smoothly curved downwardly to a respective end surface and forming an angle of at least 120 degrees with said respective end surface, said body including a notch disposed at a center of said top surface, said notch extending completely across the thickness of said body.

5. A cutting insert according to claim 4, wherein said angle is about 135 degrees.

6. A cutting insert according to claim 4, wherein said relief formed by each of said first and second top sections progressively decreases from a center of said top surface toward respective ones of said end surfaces.

* * * * *